US008091187B2

(12) United States Patent
Takazawa et al.

(10) Patent No.: US 8,091,187 B2
(45) Date of Patent: Jan. 10, 2012

(54) ZIP FASTENER END STOP

(75) Inventors: Shigeyoshi Takazawa, Cheshire (GB); Mark Davies, Cheshire (GB)

(73) Assignee: YKK Corporation (JP)

( * ) Notice: Subject to any disclaimer, the term of this patent is extended or adjusted under 35 U.S.C. 154(b) by 816 days.

(21) Appl. No.: 12/025,173

(22) Filed: Feb. 4, 2008

(65) Prior Publication Data

US 2008/0201918 A1 Aug. 28, 2008

(30) Foreign Application Priority Data

Feb. 27, 2007 (GB) ..... 0703849.0

(51) Int. Cl.
*A44B 19/36* (2006.01)

(52) U.S. Cl. ..... 24/435

(58) Field of Classification Search ..... None
See application file for complete search history.

(56) References Cited

U.S. PATENT DOCUMENTS

| | | | | |
|---|---|---|---|---|
| 3,353,233 | A | 11/1967 | Froehlich et al. | |
| 3,505,710 | A * | 4/1970 | Frohlich | 24/393 |
| 3,616,939 | A | 11/1971 | Potin et al. | |
| 4,254,539 | A | 3/1981 | Yoshida et al. | |
| 2005/0040559 | A1 | 2/2005 | Yang | |

FOREIGN PATENT DOCUMENTS

| | | | |
|---|---|---|---|
| EP | 0345799 | | 12/1989 |
| EP | 0641637 | A1 | 3/1995 |
| EP | 1 057 423 | A1 | 12/2000 |
| EP | 1 175 842 | A2 | 1/2002 |
| EP | 1321062 | | 6/2003 |
| EP | 1772071 | | 4/2007 |
| GB | 1024733 | | 4/1966 |
| GB | 1 270 179 | A | 4/1972 |
| GB | 1377053 | | 12/1974 |
| GB | 1478100 | A | 6/1977 |
| GB | 1479997 | | 7/1977 |
| GB | 2000547 | A | 1/1979 |
| GB | 2190133 | A | 11/1987 |
| GB | 2190134 | A | 11/1987 |
| JP | 2004-321547 | A | 11/2004 |
| WO | 03/037132 | A2 | 5/2003 |

OTHER PUBLICATIONS

European Office Action dated Mar. 28, 2009 in connection with counterpart EP Application No. 0825074.9.
European Search Report dated Jun. 24, 2009 in connection with counterpart EP Application No. 0825074.9.
Office Action dated Aug. 30, 2010, European Patent Application No. 08250374.9.

* cited by examiner

*Primary Examiner* — Jack W. Lavinder
(74) *Attorney, Agent, or Firm* — Kilpatrick Townsend & Stockton LLP

(57) ABSTRACT

A zip fastener comprises a pair of tapes and coupling elements along adjacent edges of the tapes. The tapes are partly cut away to form a gap into which an end stop is moulded. The end stop is provided so as to extend along the tape edges away from the fastener coupling elements.

18 Claims, 9 Drawing Sheets

ZIP FASTENER END STOP

CROSS-REFERENCE TO RELATED APPLICATIONS

The entire disclosure of British patent application number GB 0703849.0 filed on Feb. 27, 2007 is incorporated herein by reference in its entirety.

BACKGROUND

1. Field of the Invention

The present invention relates to the provision of an end stop on a zip fastener.

2. Description of the Related Art

The invention is particularly concerned with zip fasteners having moulded coupling elements and may also be used with fasteners having metallic elements which are crimped in place on the fastener tape edge.

The invention is useful with waterproof fasteners, in particular, waterproof fasteners in which waterproof layers on one surface of the fastener tapes abut one another above the plane of the coupling elements to form a seal which prevents infiltration of water. Such fasteners are described in EP-A-1175842 and EP-A-1057423, for example.

Other types of waterproof fasteners are also known. For example in WO 03/037132 abutting waterproof layers are located in the mid-plane of moulded coupling elements. In JP-P2004-321547A the waterproof layers are brought together with greater force to form a more watertight or airtight seal.

Various methods exist for forming end stops on zip fasteners. We are particularly concerned with forming a closed end stop, in which the fastener tapes are joined at the end of the run of coupling elements, and more particularly a bottom end stop. The invention is also useful for the formation of open end stops, particularly top end stops. The top end stop and the bottom end stop are provided to prevent a slider from coming off the slide fastener when it is reciprocally moved thereon to open and close the slide fastener.

Typically an end stop is formed by crimping a metal staple on to the fastener tapes or tapes. For a bottom end stop, the member may be provided to bridge the two tapes to hold them together. For a top end stop the metallic member may be crimped on to the edge of the tape. Furthermore, a top end stop may be formed at the end of the fastener elements on to the edge of each of the opposed fastener tapes to thus provide open end stops. A gap may be formed in the run of coupling elements to facilitate attachment of the end stop. This may be formed by cutting away the elements, particularly when a continuous coil type coupling element is used, or simply by creating a gap or space between discrete coupling elements as they are moulded or crimped on to the tape edge.

With a continuous coil type coupling element, there have been many attempts to utilise the coupling element itself to form an end stop. These typically involve melting the elements, such as described in GB-A-1270179 to fuse opposed elements in coupled disposition (for a bottom end stop) or to fuse adjacent elements at their upper ends on a tape edge (to form a top end stop). However, this typically results in an unsatisfactory shape to the end stop.

SUMMARY

In a first aspect of the invention we provide a zip fastener comprising a pair of fastener tapes and coupling elements along adjacent edges of the tapes, wherein the fastener tapes has an end stop provided at the end point of the coupling elements so as to extend away from the fastener coupling elements and between the tape edges.

Preferably an enlarged gap is provided between the tape edges, the gap being larger than the gap between opposed edges of the tapes at the region occupied by the coupling elements.

Preferably the enlarged gap is formed by cutting away the facing edges of the fastener tapes. Preferably the fastener coupling elements are formed by a continuous coil and the coil is cut away with the edge of the fastener tape.

Preferably the moulded material extends above the tape surface on at least one side of the tape.

Preferably the fastener is a waterproof fastener and preferably a layer of waterproof material is provided on one or both sides of the fastener tapes. Preferably the waterproof layers on the respective tapes abut to form a waterproof seal.

Preferably the material of the end stop extends over a surface of the tapes. Preferably the material of the end stop extends over an adjacent area of the waterproof layer. Preferably the moulded material of the end stop extends to an end of the tapes, and preferably forms an extension of the tape length. Preferably the moulded material extends to the outer edge of the tapes, distal of the coupling elements. The thickness of the moulded material layer may be tapered towards the outer edge of the tapes.

Preferably apertures are provided through the tapes and the moulded material of the end stops extends through the apertures.

Preferably apertures are provided in the tape to receive locating pins of a mould for moulding the end stop on the tapes.

Preferably the end stop is a bottom end stop.

In another aspect a top end stop is provided at an upper end of the coupling elements on a tape edge, the tape edge being cut away at the region covered by the end stop.

In another aspect, an end stop is formed by moulding between opposed edges of the fastener tapes to join the tapes. One or both edges may be cut away to form an enlarged gap between the opposed edges prior to moulding the end stop. Coupling elements may be cut from the tape edge at the region of the end stop prior to moulding the end stops. Preferably the elements are cut away with the tape region to which the elements are attached.

Preferably the end stop is close to an end one of the coupling elements on a tape. The end stop may overlap the end element or elements, and may encapsulate them.

Yet another aspect of the invention provides a method of forming an end stop on a zip fastener, the method comprising cutting away an edge of a fastener tape and moulding an end stop on to the fastener tape at the cut edge.

Other preferred features and aspects of the invention will be apparent from the following description and the accompanying claims.

DESCRIPTION OF THE DRAWINGS

The invention will be further described by way of example with reference to the accompanying drawings, in which.

DETAILED DESCRIPTION OF THE INVENTION

Figure 1:
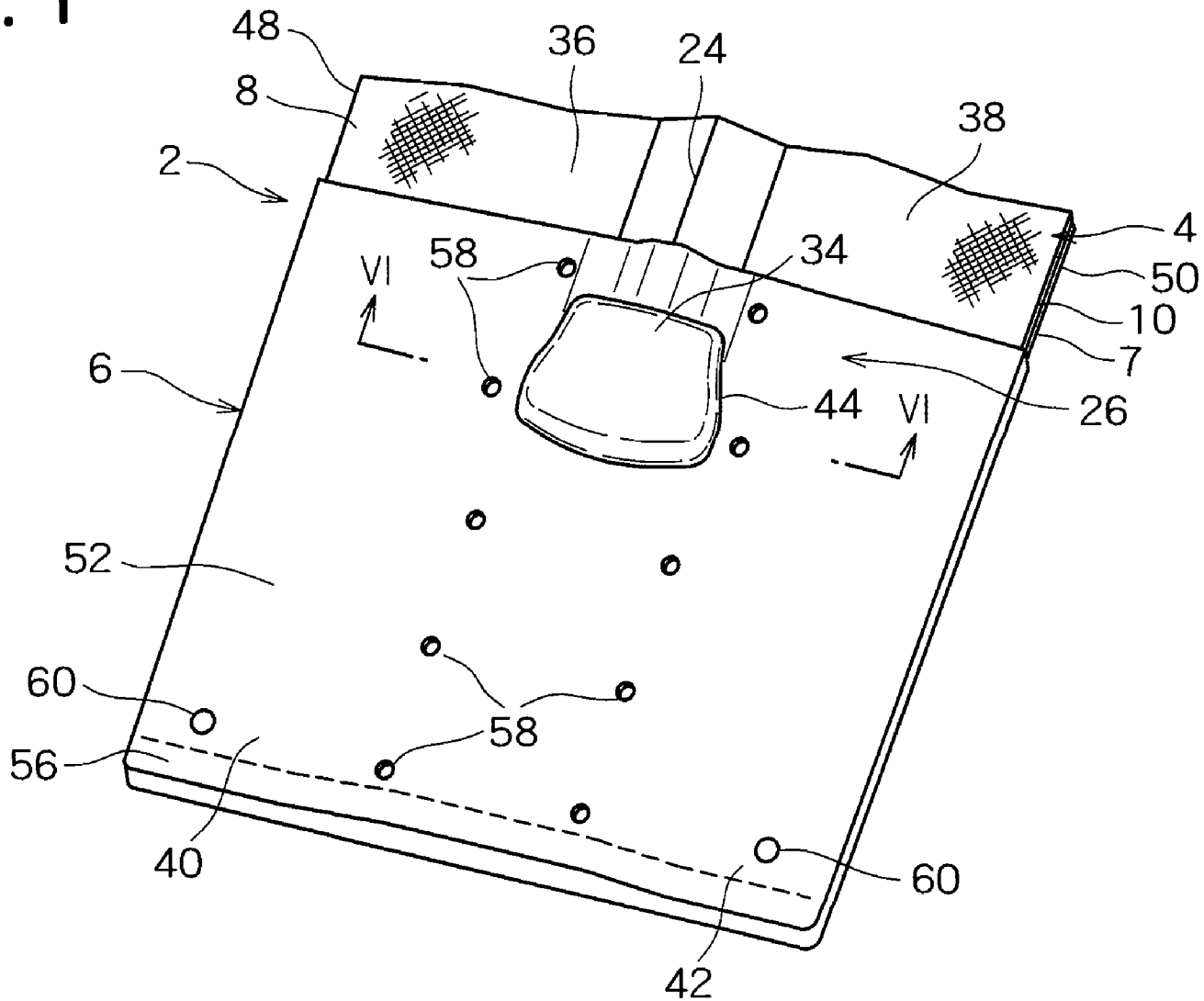
FIG. 1 is a top view of a waterproof fastener forming an embodiment of the invention.
Figure 2:
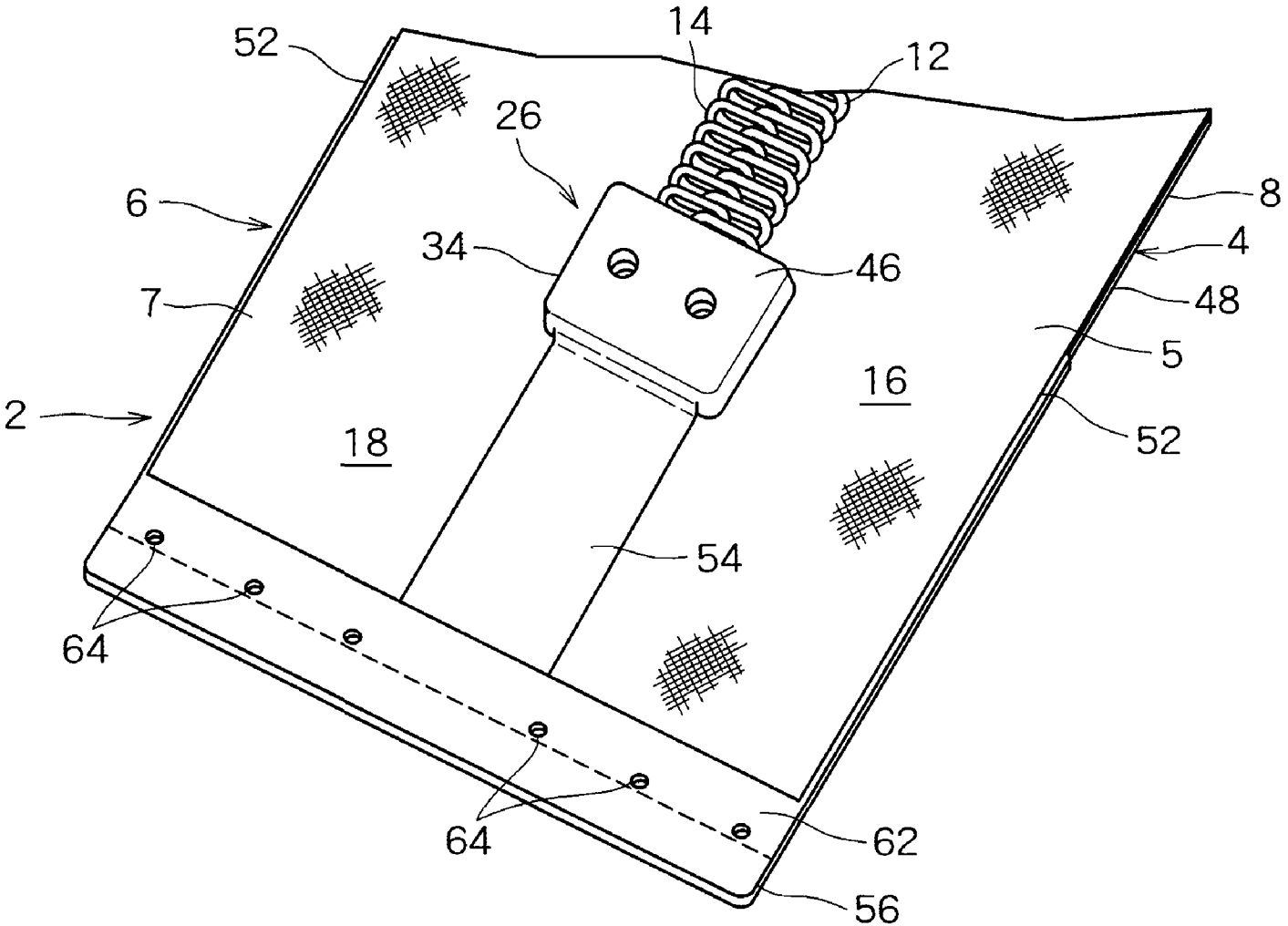
FIG. 2 is an underneath view of the fastener of FIG. 1.
Figure 3:
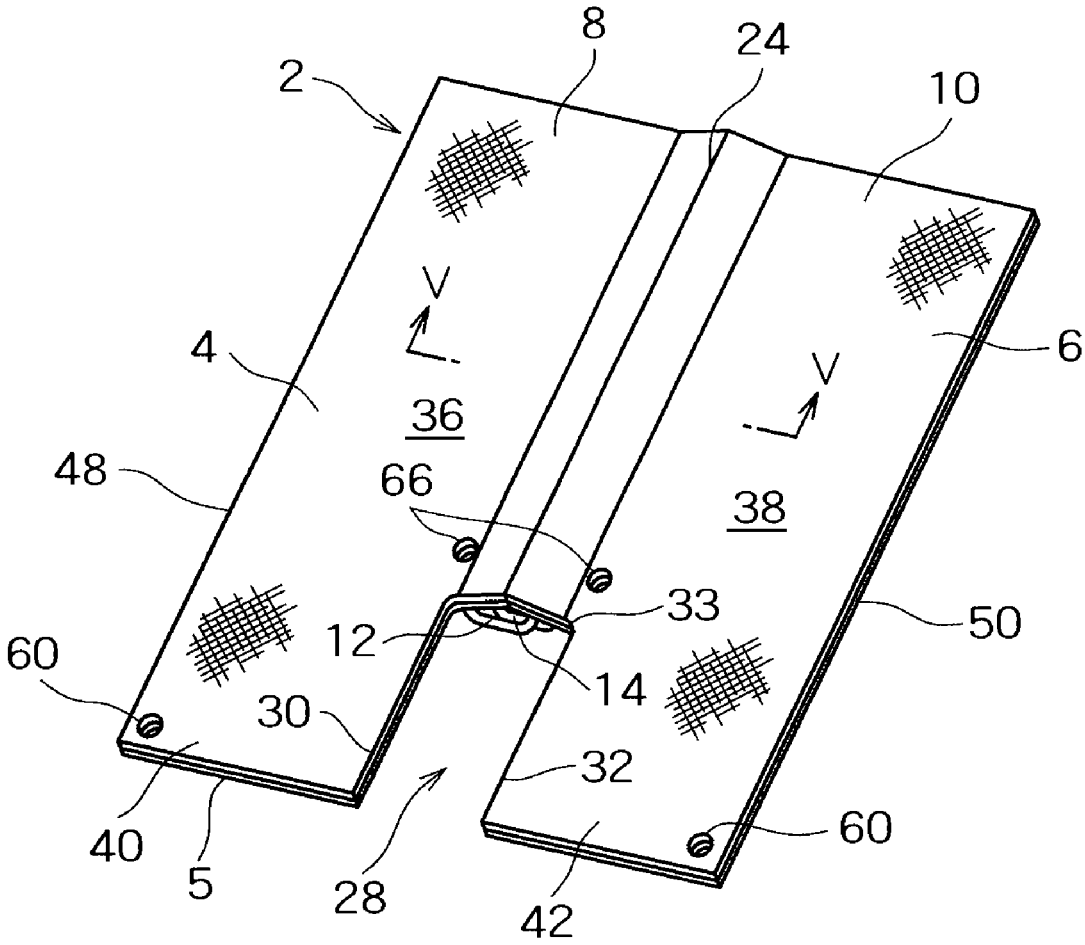
FIG. 3 is a top view of the fastener of FIG. 1, before the step of moulding a bottom end stop in place.
Figure 5:
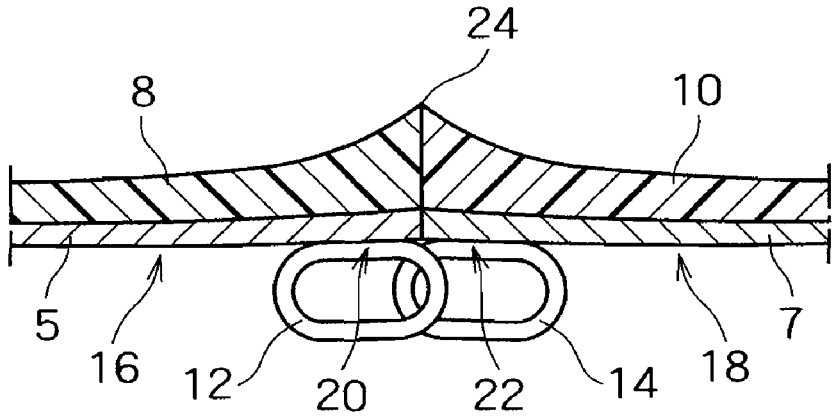
FIG. 5 shows a cross-section along the line V-V of FIG. 3.

Referring to FIGS. 1 and 2, these show a waterproof zip fastener 2 of the general type seen in EP-A-1057423. A pair of fastener tapes 4, 6, are formed of a tape layer 5, 7 of knitted or woven of material of polyester. Coupling elements 12, 14 are sewn onto underneath surfaces 16, 18 of the tapes layers 5, 7 at their adjacent edges 20, 22 as well known in the art. They may be woven or knitted into the tapes 4, 6 as the tapes 4, 6 are formed. A waterproof layer 8, 10 of waterproof elastomeric material such as polyurethane is provided on the upper surface of the tape layers 5, 7. The materials of the layers are compatible so as to bond easily to one another. The term "compatible" means the nature of being easily bonded to one another. The waterproof layers 8, 10 may be laminated in place using an adhesive or heat upon the tape layers 5, 7. We prefer to form the layers by extrusion moulding on to the tape layers 5, 7. As seen in FIGS. 3 and 5, the waterproof layers 8, 10 abut at a centre line 24 above the plane of the fastener elements 12, 14 to form a waterproof seal. The construction thus far described is well known in the art.

The coupling elements 12, 14 are brought into and out of coupling engagement with each other by reciprocal movement of the slider (not shown). The slider is comprised of a pair of upper and lower wings connected by a guide post at their fronts, which is a typical structure of a slider. However, the slider is not necessarily limited to this typical structure.

Shown in FIGS. 1 and 2 is a moulded bottom end stop indicated generally by the reference numeral 26.

Figure 4:
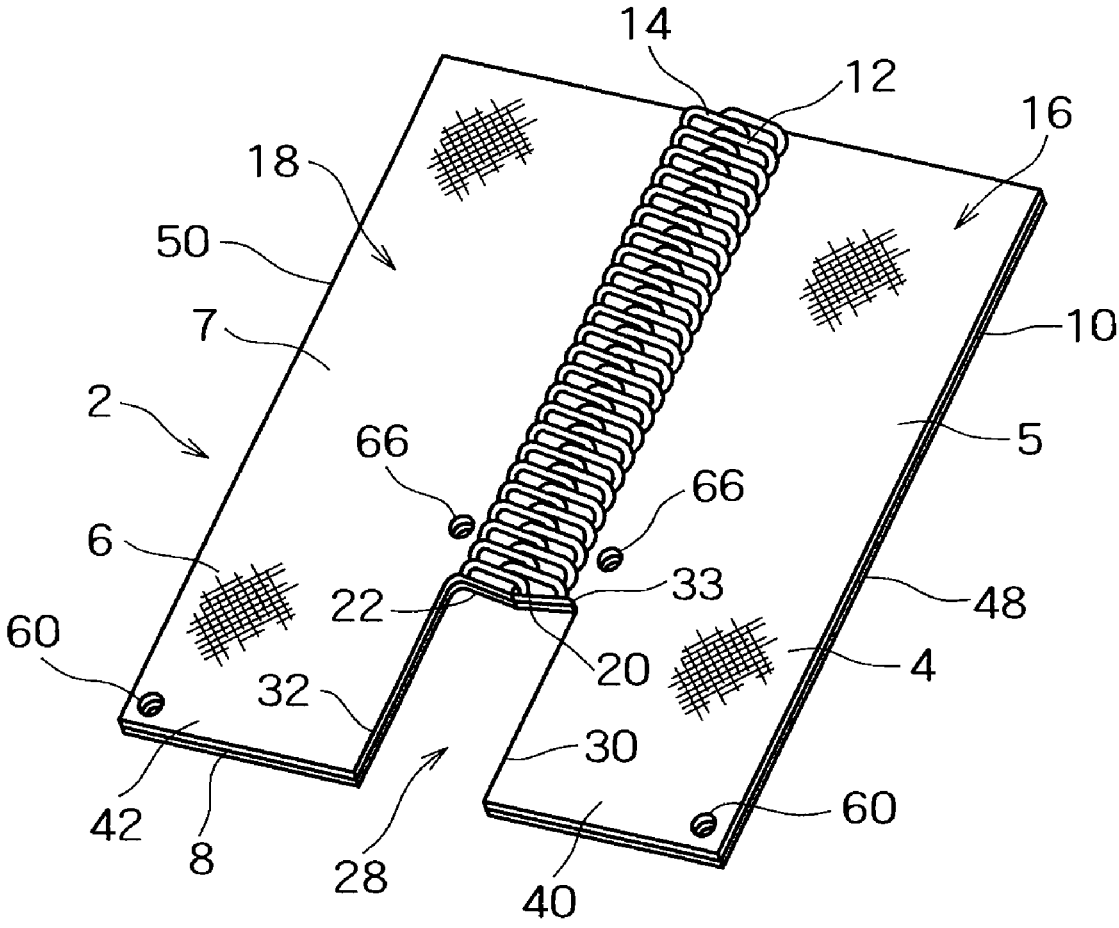
FIG. 4 is an underneath view of the fastener of FIG. 1 before the step of moulding the bottom stop in place.

The formation of the end stop 26 will firstly be described with reference to FIGS. 3 and 4 which show the zip fastener 2 prior to formation of the end stop 26. As can be seen in FIGS. 3 and 4, a portion of the fastener tapes 4, 6 has been cut away to leave an enlarged gap 28 between opposed edge regions 30, 32 of the tape edges 20, 22 extending down from an end point 33 of the coupling elements. The cut away region is sufficiently wide to completely remove the coupling elements 12, 14 and the tape edge supporting them, and extends from the end point 33 of the remaining elements 12, 14 down to the ends 40, 42 of the fastener tapes 4, 6. Consequently, in the coupled zip fastener 2, the distance between the adjacent tape edges in the gap 28 is greater than the width of the coupling elements in coupled disposition. The gap 28 may be cut by one of a variety of methods, by a stamping method using a press for example, by a knife or the like, by heat cutting to seal the tape edge, by using a laser, for example.

Referring to FIGS. 1 and 2, the gap 28 is filled by moulding end stop 26 in place. The preferred form of the end stop 26 is shown in FIGS. 1 and 2. End stop 26 is moulded of a material compatible with the waterproof layer 8, 10, in this case polyurethane is preferred, so as to bond to the waterproof layer during moulding. Preferably the material of the end stop is also compatible with the material of the layers 5, 7 so as to bond to them during moulding. As mentioned above, the layer 8, 10 itself is compatible with the material of the fastener tapes 4, 6 so as to adhere thereto when extrusion moulded on to the layers 5, 7. End stop 26 has a body portion 34 having an upper part 44 which extends above, that is above, the upper surface 36, 38 of the waterproof layers 8,10. Body portion 34 also has a lower part 46 which extends beyond the underneath surface 16, 18 of the layers 5, 7. Body portion 34 encapsulates or extends over the last one or two of the coupling elements above the end point 33 of the coupling elements 12, 14. and over both the underneath and upper surfaces of the tape 4, 6 at that region. The body portion 34 serves to prevent the slider (not shown) from coming off the coupling elements 12, 14 during its reciprocal movement along the coupling elements 12, 14 for coupling and decoupling the coupling elements 12, 14.

Figure 6:
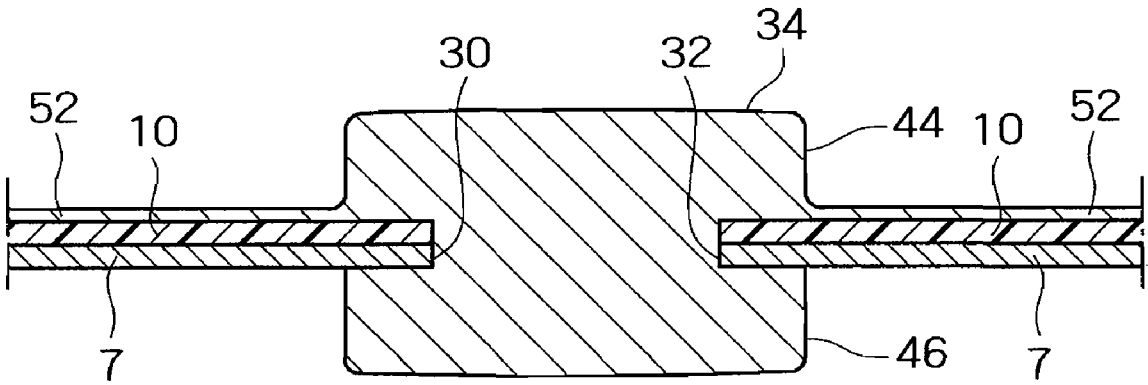
FIG. 6 shows a cross-section along the line VI-VI of FIG. 1.

As seen in FIG. 6, the body portion 34 fills the gap 28 between the opposed edges 30, 32 of the tapes 4, 6. Body portion 34 also overlaps the tape edges 30, 32 to bear on and bond to the underneath surfaces 16, 18 of the fabric layers 4, 6 and the upper surfaces 36, 38 of the waterproof layers 8, 10.

Referring to FIG. 1, the material of the end stop 26 forms a layer 52 which extends over the upper surfaces 36, 38 of the waterproof layers 8, 10 and bonds to the surfaces 36, 38 of compatible layers 8, 10. The layer 52 extends to the outer edges 48, 50 of the tapes 4, 6, distal of the elements 12, 14, and may extend around the edge as seen in FIG. 2, to slightly increase the width of the tapes. As shown in FIG. 2, the material of the end stop 26 also forms layer 54 which extends over the underneath surfaces 16, 18 of the fabric layers 4, 6, but to a lesser extent than layer 52. The layer 54 is moulded so as to extend downwards from the lower part 46 of the body portion 34 along the opposed edges 20, 22 of the pair of fastener tapes 4, 6 and to fill up a space between the opposed edges 20, 22. The upper part 44 and the lower part 46 of the body portion 34 projects beyond the layer 52 which bonds to the surfaces 36, 38 and the layer 54 which extends over the underneath surfaces 16, 18, respectively.

The material of the end stop extends down to the ends 40, 42 of the tapes 4,6 and extends beyond the tape ends 40, 42 to form a region 56 which lengthens the tapes 4, 6 and forms a seal at the tape ends 40, 42. End region 56 may also extend around the tape ends 40, 42 to sandwich the fabric layers 5, 7 between the waterproof layer 8, 10 and the layer 62.

Also shown in FIGS. 1 and 2 are small apertures 58 in the layers 52 where support pins in the mould (see FIGS. 9 and 10) have served to hold the tapes 4, 6 in position during moulding, and apertures 64 in layer 62. Apertures 60 at the bottom corners of the tapes 4, 6 (FIGS. 3 and 4) are for locating pins which hold the tapes in a fixed position in the mould. Also shown in FIG. 2 are holes formed in the lower part 46 of the end stop body portion 34 by locating pins which serve to hold the elements 12, 14 in position during moulding. Referring to FIGS. 3 and 4, though holes 66 are formed to each side of the coupling elements 12, 14 at the intended location of the end stop body portion 34. The material of the body portion 34 extends through the holes 66 and join the front and rear surfaces in order to reinforce the grip of the body portion 34 on the fastener tapes at the end point 33 of the coupling elements 12, 14.

Although the enlarged gap 28 extends to the tape ends 40, 42, the gap may stop short of the ends 40, 42. However it is still preferred to remove all of the coupling elements in the region extending to the tape ends 40, 42 to provide a more attractive finish. This may also be more comfortable for a wearer, since the wearer has been fully relieved from unpleasant feel of unevenness which he would suffer if coupling elements remained.

Figure 7:
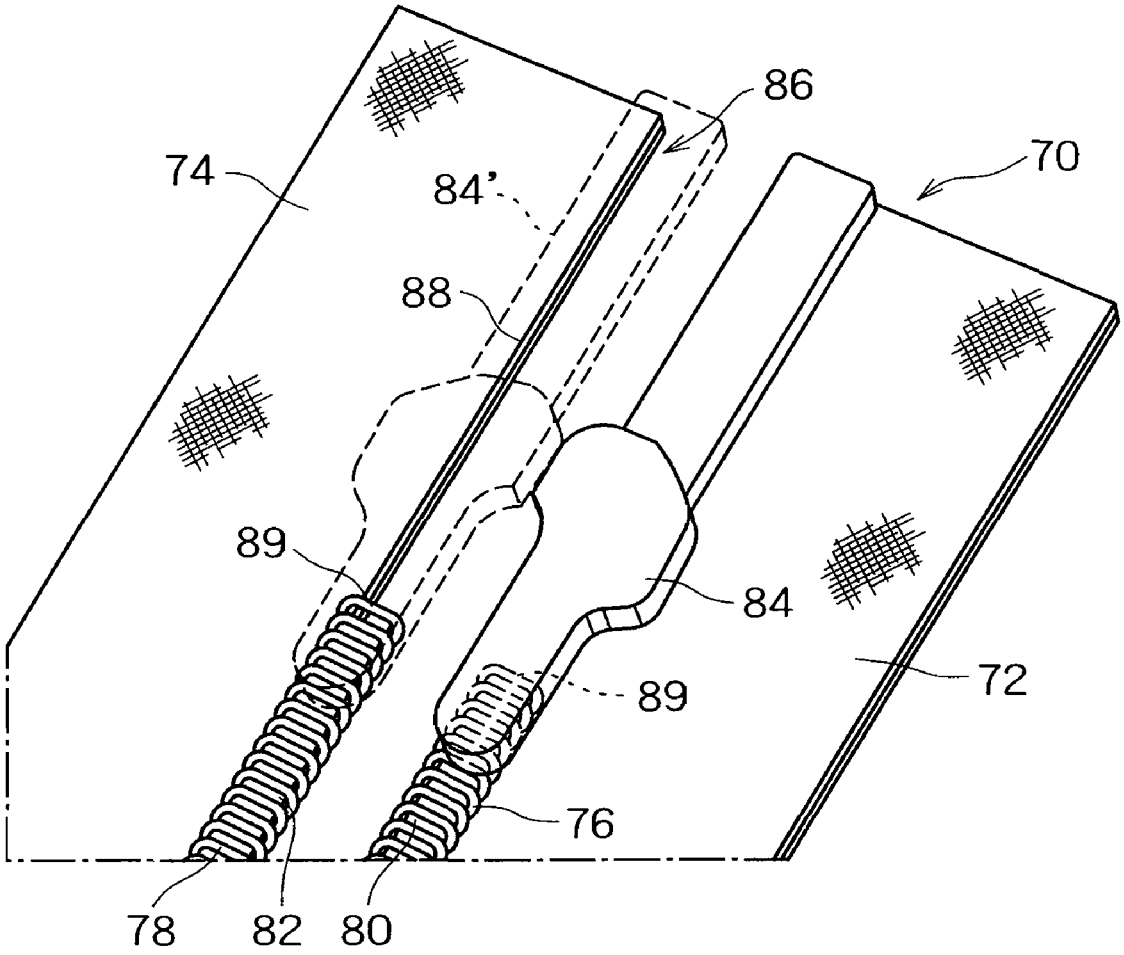
FIG. 7 shows open end stops forming an embodiment of the invention.

Referring to FIG. 7, this shows a zip fastener 70 comprising woven or knitted fastener tapes 72, 74 which have coil type coupling elements 76, 78 sewn along adjacent edges 80, 82. The fastener tapes are the same as those shown in FIGS. 1 through 6. On one tape, 72, an open type end stop 84 has been moulded. The end stops 84, 84' are adapted to come into abutting engagement with the slider, with their parts inserted into the slider, to thus prevent the slider from coming of the coupling elements. The drawing shows the other tape 74 with its edge region 82 cut away at a region 86, removing the coil elements 78 to form a recessed edge 88, and prior to the moulding of an open end stop 84' (shown in dotted outline) onto the tape 74. Since the edge region 82 has been cut away at the region 86 and the coil elements 78 has been removed, the distance between the recessed edges 88 of the opposed tapes 72, 74 are greater than the distance between the opposed edges of the tapes in the part where coupling elements remain, and the recessed edges 88 is receded from the opposed edges of the tapes in the part where coupling elements remain. The end stop 84, 84' will cover the last few coupling elements below an end point 89 at the end of the row of coupling elements. The upper extensions of the end stops 84, 84' extends over the recessed edges 88 where coupling elements 78 have been removed up to the upper ends of the fastener tapes 72, 74, respectively.

Since the top stop is thus formed at the tape edges where the coupling elements have been removed, unevenness or roughness otherwise provided by the coupling elements has been eliminated. Furthermore, the extensions of the end stops 84, 84' cover the tape edges, thus, the grip of the end stops 84, 84' on the tapes has been advantageously enhanced. Furthermore, since the tape edges can be made flat and even, the wearer enjoys pleasant feel. Moreover, as coupled with the layer 52 (shown in FIGS. 1 through 6) formed on the side opposite to the side of the fastener tape shown in FIG. 7, this helps to render the end stops and the tape edges of the fastener tapes more even or smooth.

Figure 8:
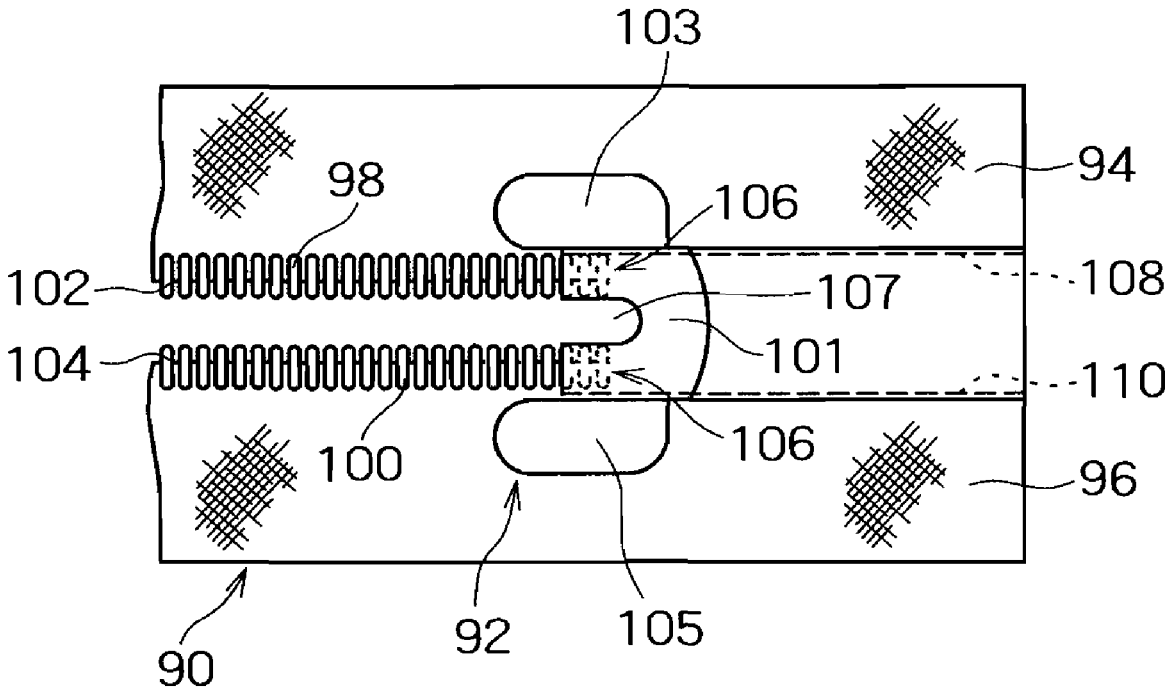
FIG. 8 shows a closed top end stop forming an embodiment of the invention.

Referring to FIG. 8, this shows a zip fastener 90 having a closed top end stop 92 which joins two woven or knitted fastener tapes 94, 96 which have coil type coupling elements 98, 100 along opposed tape edges 102, 104.

The coupling elements 98, 100 and the supporting tape edges 102, 104 have been cut away above an end point 106 to form recessed tape edges 108, 110 receded from the end point 106 of the coupling elements 98, 100. End stop 92 is moulded over the end coupling elements, at the end point 106, along the cut away tape edges 108, 110 and between the tape edges.

As the bottom end stop shown in FIGS. 1 through 6, this top end stop 92 joins the fastener tapes. The top end stop 92 has a end stop body 101 provided at the end point 106 of the coupling elements 98, 100 so as to extend over the coupling elements 98 100 at the end point 106. The end stop body 101 serves to prevent the slider from coming off the coupling elements 98, 100. The end stop body 101 is of inverted U-shape to thus provide in the middle a recess 107 which is open toward the coupling elements 98, 100. The recess 107 also constitutes a space adapted to receive the guide post of the slider when the slider comes into contact with the end stop body 101. A pair of fins 103, 105 are integrally formed one on each side of the end stop body 101 of the top end stop 92 so as to extend over the upper surface of the fastener tapes 94, 96, so that the grip of the top end stop 92 on the fastener tapes 94, 96 are enhanced. Although FIG. 8 does not show the rear side of the zip fastener, preferably, a layer is bonded over the fastener tape as the layer 52 of the bottom end stop 26 shown in FIG. 1.

Figure 9:
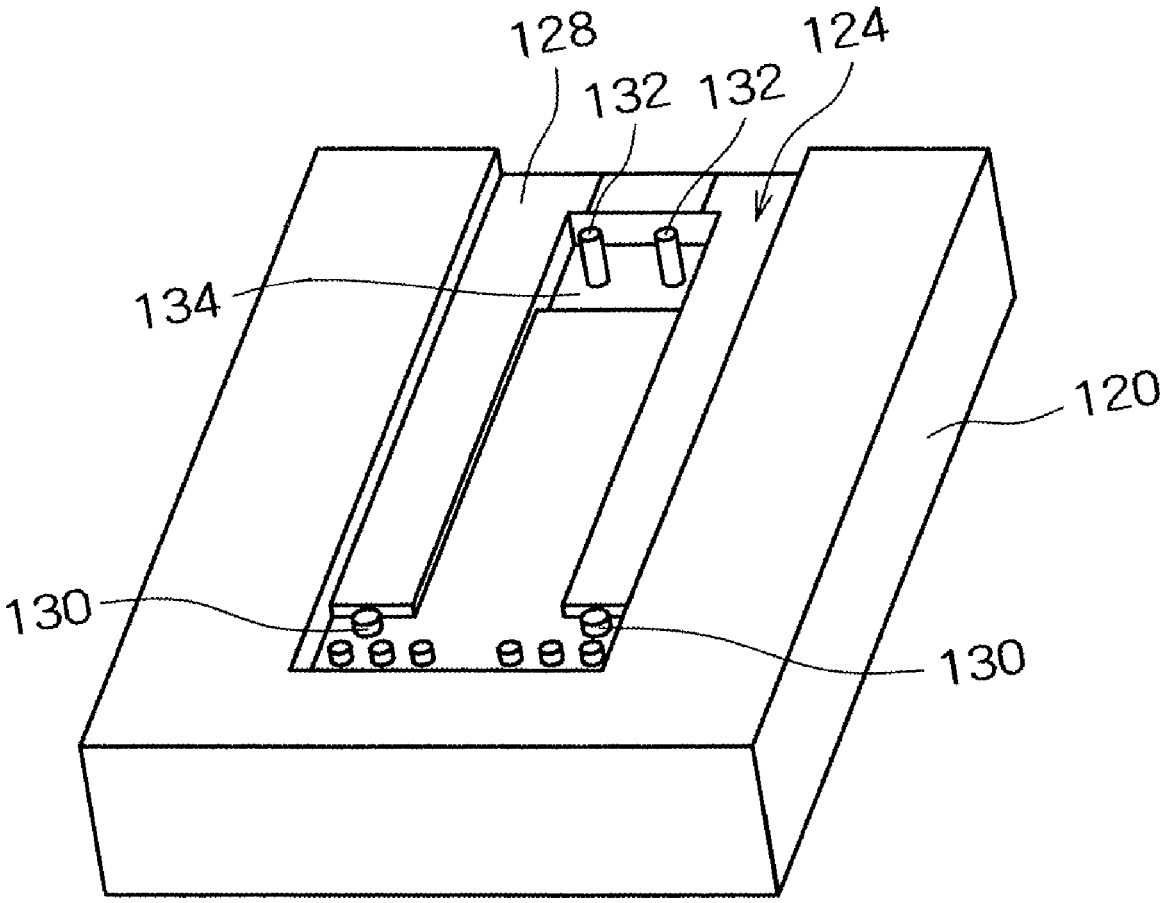
FIGS. 9 and 10 show schematically mould halves for moulding an end stop forming an embodiment of the invention.
Figure 10:
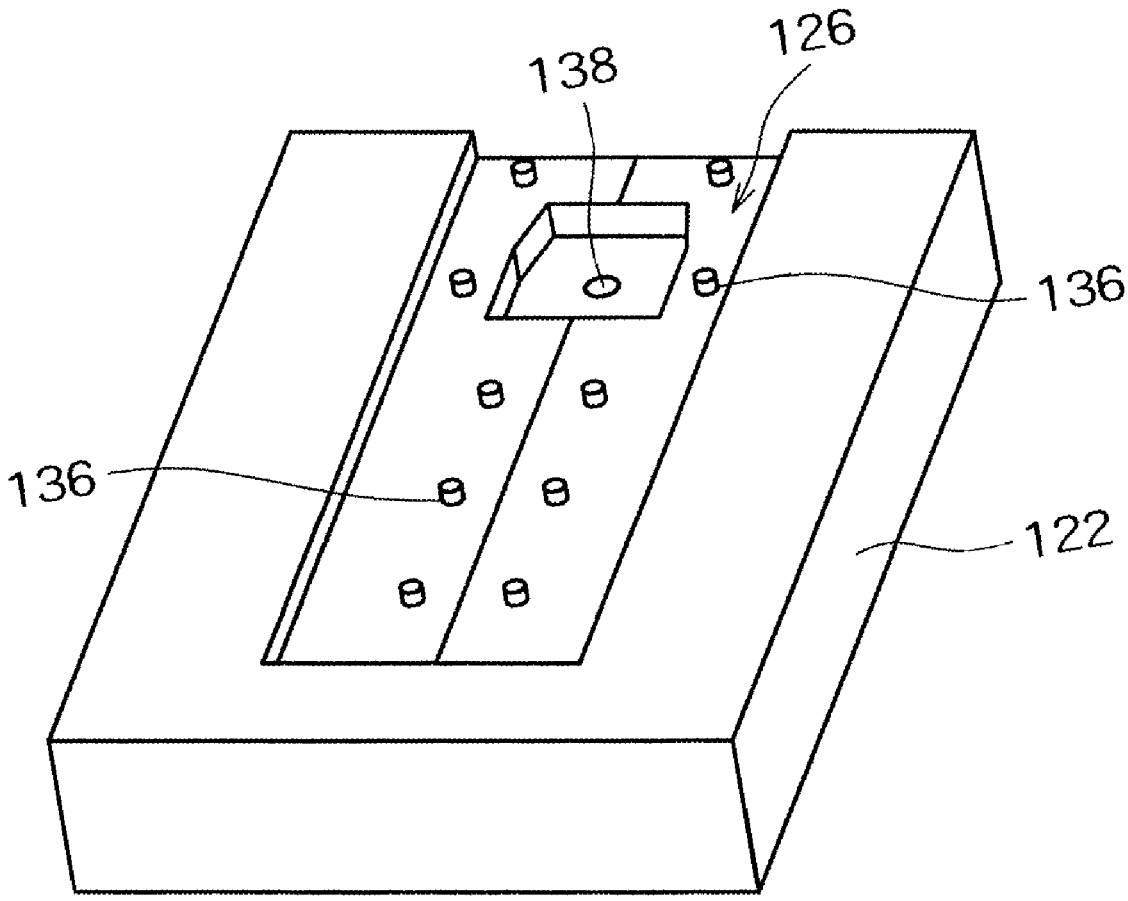

FIGS. 9 and 10 show schematically mould halves 120, 122 for forming an end stop on the end of a zip fastener by insert moulding, that is placing the fastener end in the mould cavity 124, 126 and then injecting the material of the end stop 26 into the mould cavity. In the method of the invention, the gap 28 is cut in the end of the fastener 2, as described above, and location apertures 60 also formed in the tape ends 40, 42. The fastener end is positioned with the layers 5,7 facing the bottom surface 128 of mould cavity 124 and apertures 60 located over pins 130. The end coupling elements of the cut fastener are supported by pins 132 in a cavity 134 which forms the end stop body portion 46. As the mould halves are brought together, pins 136 in mould half 122 hold the fastener in place as molten plastics material is injected though inlet 138 in a cavity 140 which also serves to define the shape of the upper end stop body portion 44.

Although we have described the invention with respect to coil type coupling elements it will be appreciated that the invention is also applicable to fasteners having moulded coupling elements (such as Vislon™ fasteners of the applicants). Instead of cutting such moulded elements, it is possible to form a gap in the element chain during manufacture, and so cut away only the tape edge where it is desired to from a larger gap between the opposed tape edges prior to moulding the end stop in place.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

The invention claimed is:

1. A zip fastener comprising a pair of fastener tapes and coupling elements along adjacent edges of the tapes, the coupling elements each ending at an end point, wherein the fastener tapes are joined by an end stop between the tape edges which is molded at the end points of the coupling elements, wherein the end stop includes a body portion, an upper surface layer, and an underneath surface layer, wherein the upper surface layer extends from the body portion to the outer edges of the fastener tapes and towards the ends of the fastener tapes on an upper surface of the end stop, and the underneath surface layer extends from the body portion towards the ends of the fastener tapes on an underneath surface of the end stop, and wherein the end stop fills an enlarged gap between the tape edges, the gap being larger than a gap between the adjacent edges of the tapes at a region occupied by the coupling elements.

2. A zip fastener as claimed in claim 1, further comprising open end stops that are provided adjacent to the end points of the coupling elements.

3. A zip fastener as claimed in claim 2, wherein one of the open end stops is provided to cover adjacent edges of the tapes.

4. A zip fastener as claimed in claim 2, wherein facing edges of both fastener tapes are cut away and the open end stops are provided on both tape edges.

5. A zip fastener as claimed in claim 1, wherein the enlarged gap is formed by cutting away an edge of a fastener tape.

6. A zip fastener as claimed in claim 5, wherein facing edges of both fastener tapes are cut away to form the enlarged gap.

7. A zip fastener as claimed in claim 5, wherein the fastener coupling elements are formed by a continuous coil and the coil is cut away with the edge of the fastener tape.

8. A zip fastener as claimed in claim 1, wherein the moulded material of the end stop extends above a surface of the tape on at least one side of the fastener.

9. A zip fastener as claimed in claim 1, wherein the fastener is a waterproof fastener and each of the fastener tapes includes a layer of waterproof material on one or both sides of the fastener tape.

10. A zip fastener as claimed in claim 9, wherein a portion of the end stop extends over each of the layers of waterproof material.

11. A zip fastener as claimed in claim 1, wherein each of the tapes includes a waterproof layer and the waterproof layers of the respective tapes abut to form a waterproof seal.

12. A zip fastener as claimed in claim 1, wherein a portion of the end stop extends over a surface of the tapes.

13. A zip fastener as claimed in claim 1, wherein the moulded material of the end stop extends to an end of the fastener tapes.

14. A zip fastener as claimed in claim 13, wherein the moulded material of the end stop forms an extension extending along a length direction of the fastener tapes.

15. A zip fastener as claimed in claim 1, wherein apertures are provided through the tapes and the moulded material of the end stops extends through the apertures.

16. A zip fastener as claimed in claim 1, wherein apertures are provided in the tape to receive locating pins of a mould for moulding the end stop on the tapes.

17. A zip fastener as claimed in claim 1, wherein the end stop encapsulates one or more of the coupling elements.

18. A zip fastener as claimed in claim 1, wherein the body portion projects beyond the upper surface layer and the underneath surface layer.

* * * * *